United States Patent [19]

Cunningham

[11] 4,102,415

[45] Jul. 25, 1978

[54] DRILLING DEVICE

[76] Inventor: Wesley B. Cunningham, 2 Morris St., Charlestown, W. Va. 25301

[21] Appl. No.: 766,827

[22] Filed: Feb. 8, 1977

[51] Int. Cl.[2] ..... E21B 3/08

[52] U.S. Cl. ..... 175/96; 175/99; 175/104; 175/106; 175/352; 175/373

[58] Field of Search ..... 175/104, 96, 99, 106, 175/103, 35 L, 373

[56] References Cited

U.S. PATENT DOCUMENTS

| | | | |
|---|---|---|---|
| 223,230 | 1/1880 | Jenkins | 175/352 |
| 2,310,289 | 2/1943 | Hokanson | 175/273 |
| 3,376,942 | 4/1968 | Van Winkle | 175/99 |
| 3,431,989 | 3/1969 | Waterman | 175/106 |
| 3,770,067 | 11/1973 | Ikeda | 175/96 |
| 3,866,678 | 2/1975 | Jeter | 175/104 |

*Primary Examiner*—Ernest R. Purser

*Assistant Examiner*—William F. Pate, III

*Attorney, Agent, or Firm*—Sughrue, Rothwell, Mion, Zinn and Macpeak

[57] ABSTRACT

Earth drilling equipment includes a main body tube with jacks to releasably support it within a drilled shaft, or within an erected start up shaft. An outer casing is rotatably mounted within the main body tube, and carries a horizontal base on which are driven wheels, and vertical shafts which have cutting elements. Means within the casing for fluid input and evacuation within the drill area is provided to form a slurry of the fluid and excavated material for withdrawal through the casing. As drilling continues, the main body tube is lowered into the shaft.

The cutting elements include plates with cutting edges mounted on individual axles such that the edges are maintained in cutting relation to the area to be drilled.

7 Claims, 10 Drawing Figures

DRILLING DEVICE

BACKGROUND OF THE INVENTION

1. Field of the Invention

This invention relates to earth and rock boring apparatus, finding particular utility in the formation of vertical shafts to mines or other subterranean installations.

2. Statement of the Prior Art

It has been previously known to provide a plurality of drills supported in a casing within a housing pipe and to rotate both the support and pipes while the drills are free to rotate about their axis. Representative of patented art is U.S. Pat. No. 3,945,445.

SUMMARY OF THE INVENTION

The present invention provides a large diameter earth and rock boring apparatus which eliminates the necessity for driving a drill stem from above ground, and which relies principally upon the mass and weight of the drill assembly for its bore function. The assembly hereof is driven, and is provided with fluid input and exhaust means for evacuation of drilled material.

In presently practiced mining procedures, particularly in certain types of long shaft coal mines, it is necessary as the shaft is extended to provide periodic vertical intercept shafts. Conventionally, the intercept shafts are formed by blasting, drilling and excavation in clam shell buckets and the like. This procedure is not only costly and dangerous, but often results in shafts of irregular form having fragmented, unstable side walls. Also, blasting often causes flooding by disruption of adjacent subterranean water sources, and in that event, the shaft walls must be lined with concrete resulting in additional cost.

The present invention provides a method and means for the construction of shafts of the type described above, embodying the essential characteristic of pulverization of material to be drilled, combination of the pulverized material with a fluid medium to form a slurry, and pumping of the slurry to the surface for disposal.

The apparatus hereof is adapted for operation from the surface thereby avoiding dangers inherent in those devices requiring personnel to be present at the bottom of shaft.

The unit hereof comprises a main body section of tubular form, supported for releasable stationary positioning, a casing with a lower hub supporting free wheeling cutters, and fluid input and exhaust means. The rate of drilling is a function of the weight and mass of the cutting elements, and the rate of motion thereof.

Other and further objects and advantages of the invention will become apparent to those skilled in the art from a consideration of the following specification when read in conjunction with the annexed drawing.

DESCRIPTION OF THE PREFERRED EMBODIMENT

Figure 1:
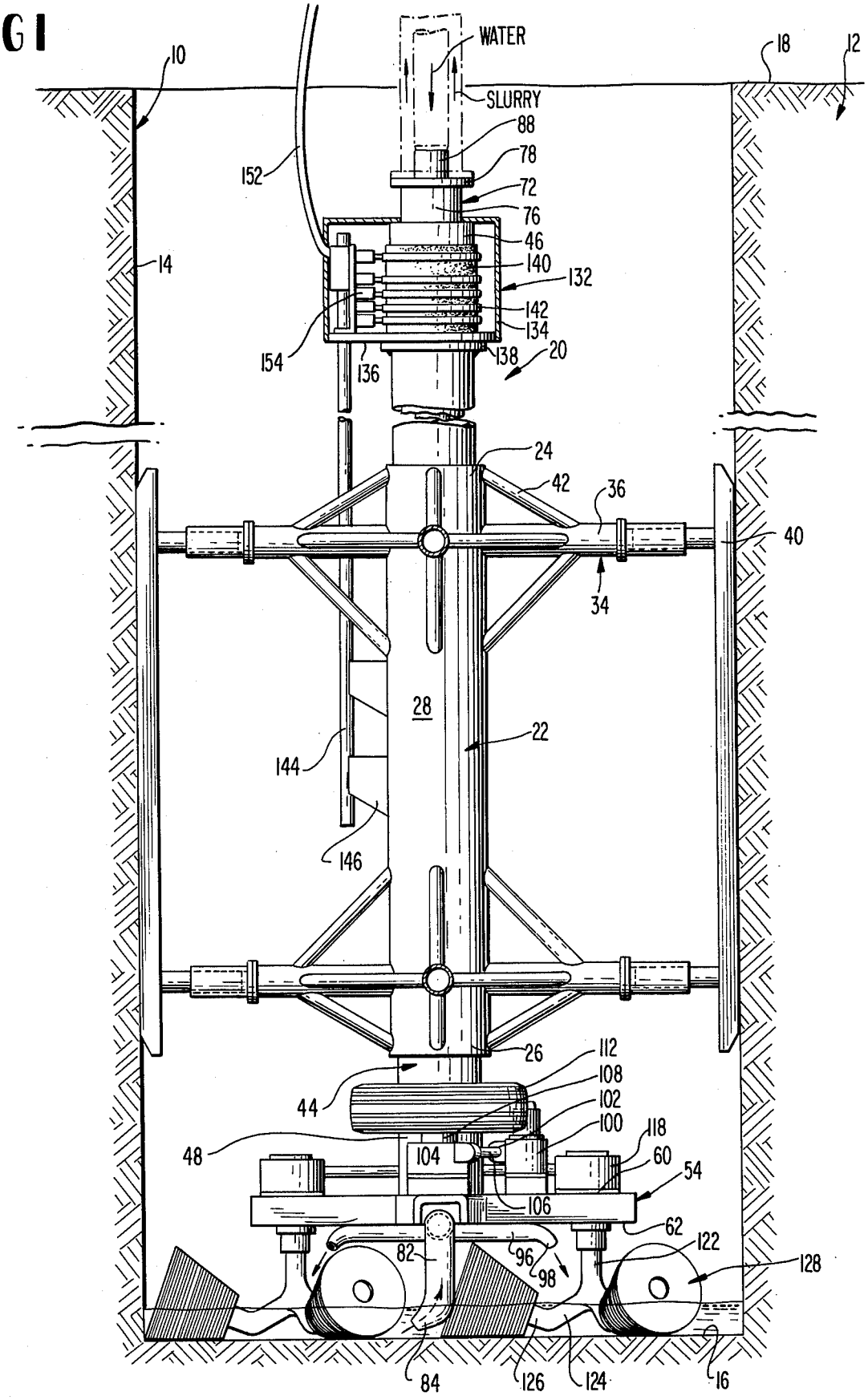
FIG. 1 is an elevational view taken through a section of drilled shaft, showing earth drilling equipment constructed and assembled in accordance with the teachings of this invention, vertically foreshortened.

Referring to the drawings in more detail, the invention finds its principal environment of intended utilization in the formation of a substantially vertical shaft 10 in the earth 12. The shaft 10, as it is formed, has an inside wall 14, and drilling occurs at its bottom 16. The bottom is, during drilling, constantly eroded by the action of the apparatus, commencing from the surface 18 to a desired depth or to an intersection with a tunnel or the like.

Figure 4:
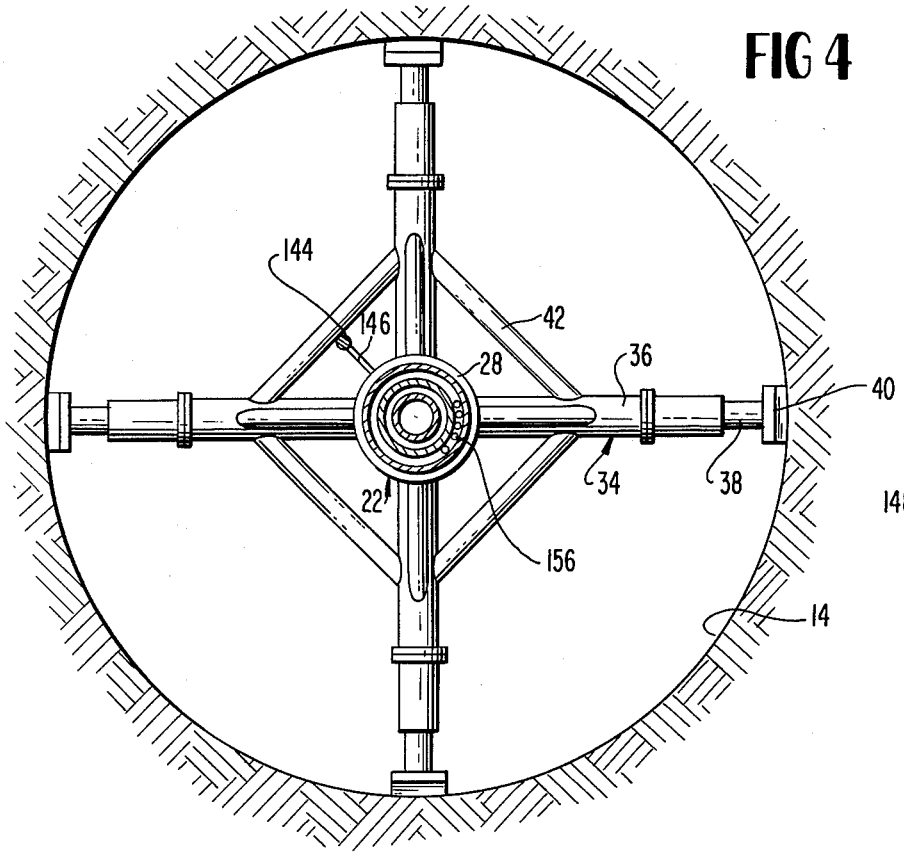
FIG. 4 is a horizontal cross sectional view taken to show the jack arrangement.
Figure 5:
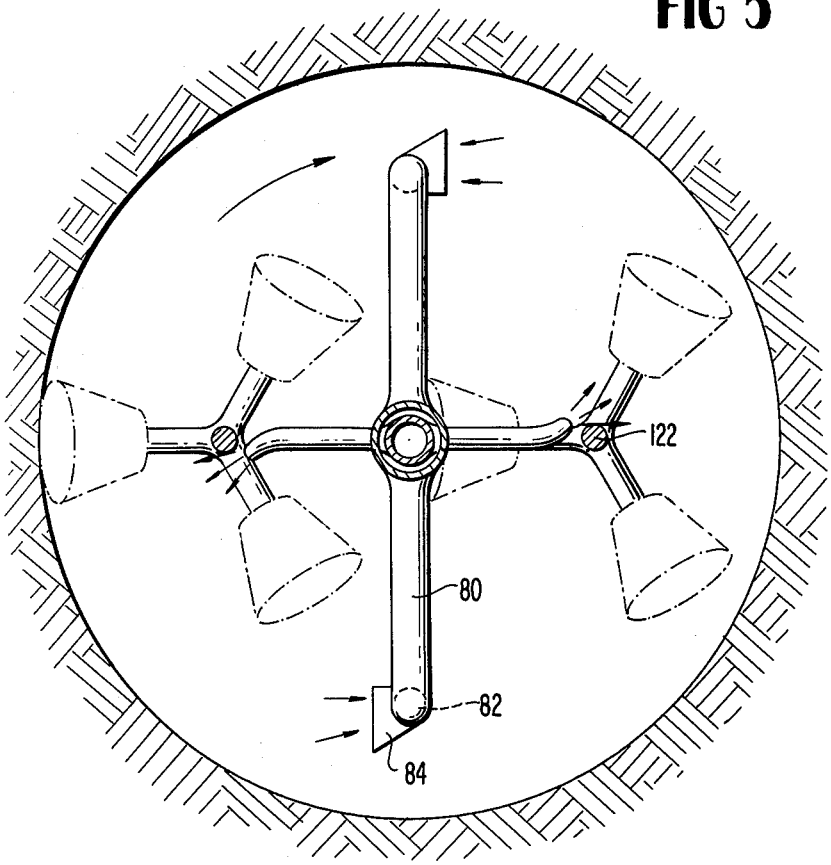
FIG. 5 is another sectional view looking down, taken below the base to disclose the fluid input and exhaust means, the cutting elements being shown in phantom lines.
Figure 6:
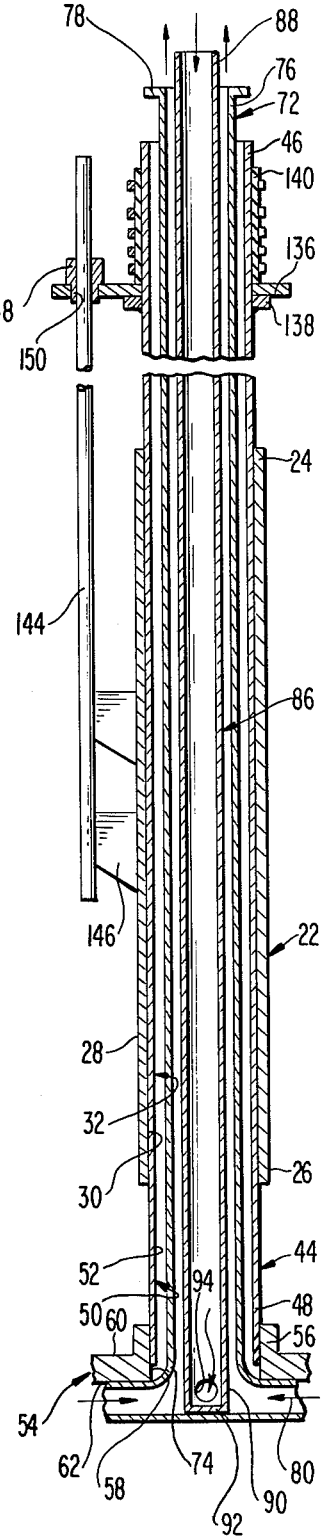
FIG. 6 is a foreshortened vertical sectional view taken through the main body tube and casing; and FIGS. *7a* through *7d* are schematic views showing sequences of operation.
Figure 7A:
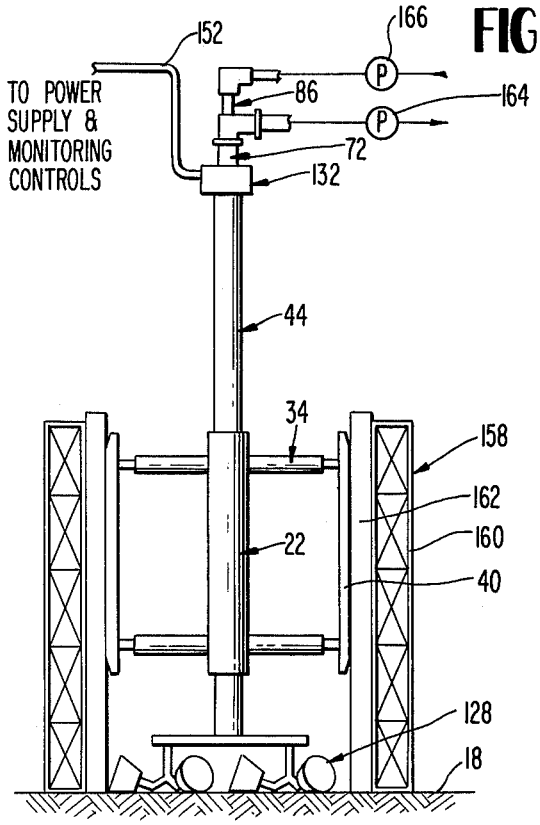
Figure 7B:
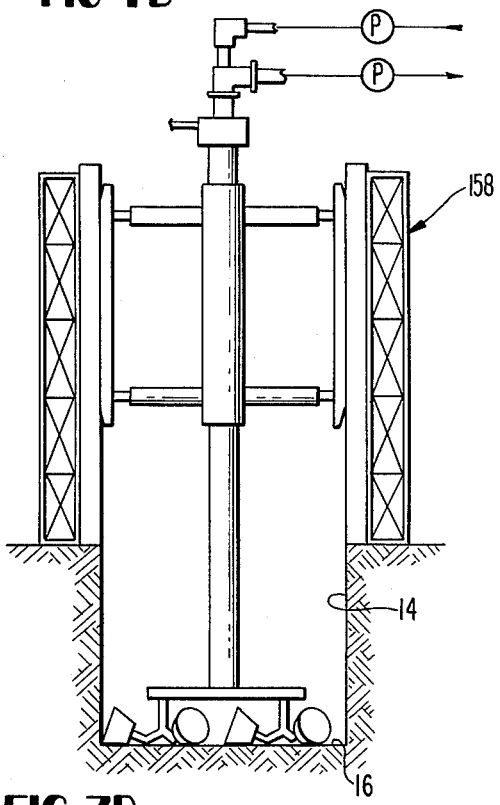
Figure 7C:
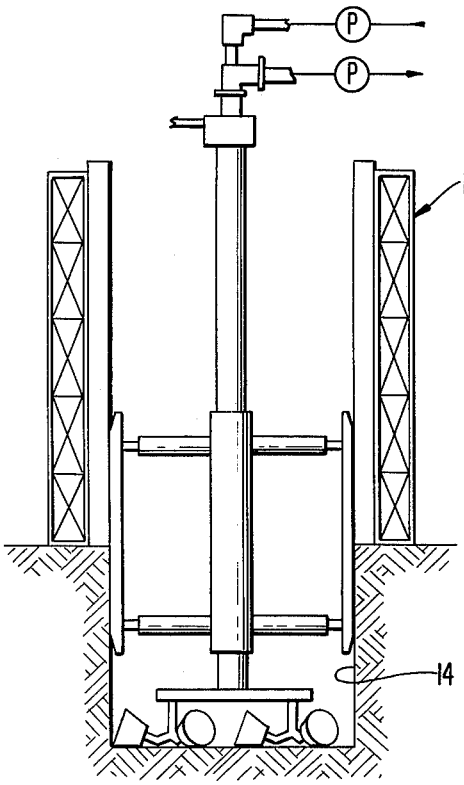
Figure 7D:
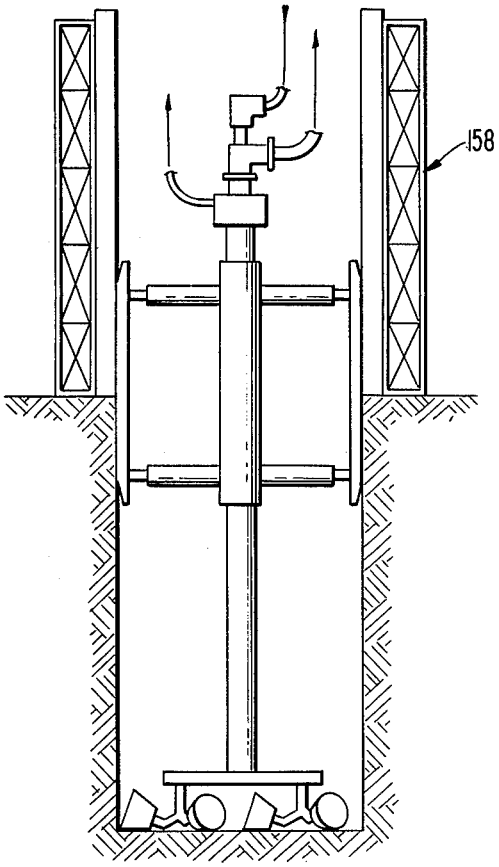

The apparatus hereof is generally identified in the drawing by reference character 20. A principal structural and functional component of the unit 20 is an elongated main body tube 22 which is normally vertically disposed when the unit is in use. The main body tube 22 has upper and lower ends 24, 26, an outer side wall 28, and an inside wall 30 defining a bore 32 (FIG. 6). In FIGS. 1 and 4, it will be observed that a plurality of jack assemblies 34 are fixedly secured on the outer side wall 28, each comprising a fixed lateral sleeve 36 with a extensible and retractable rod 38 projecting from its end remote from the main body tube. The rods are connected at the outer ends to elongated abutment members 40 which extend between and interconnect vertically aligned pairs of the jacks. The jack sleeves 36 are rigidified and reinforced by a series of braces 42 which extend back to the main body tube and between one another of the sleeves. The jacks may be hydraulic or otherwise actuated.

Disposed vertically within the main body tube 22 is an elongated, tubular outer casing 44. The casing has a top end portion 46, and an opposite bottom end portion 48, the top and bottom end portions projecting above and below the upper and lower ends 24, 26, respectively, of the main body tube. The casing 44 is rotatably journaled within the bore 32 of the main body tube, as described more fully hereinafter, and has a vertical passageway 50 defined by its interior wall 52.

Figure 2:
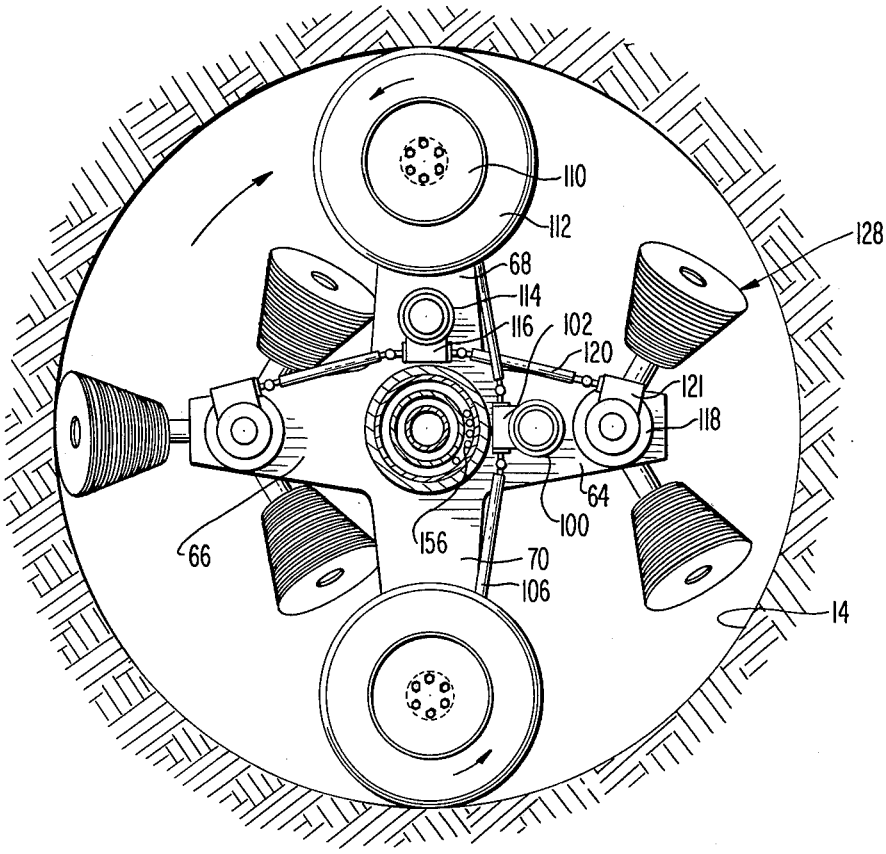
FIG. 2 is a sectional view looking down on the cutting component, of the unit shown in FIG. 1.
Figure 3:
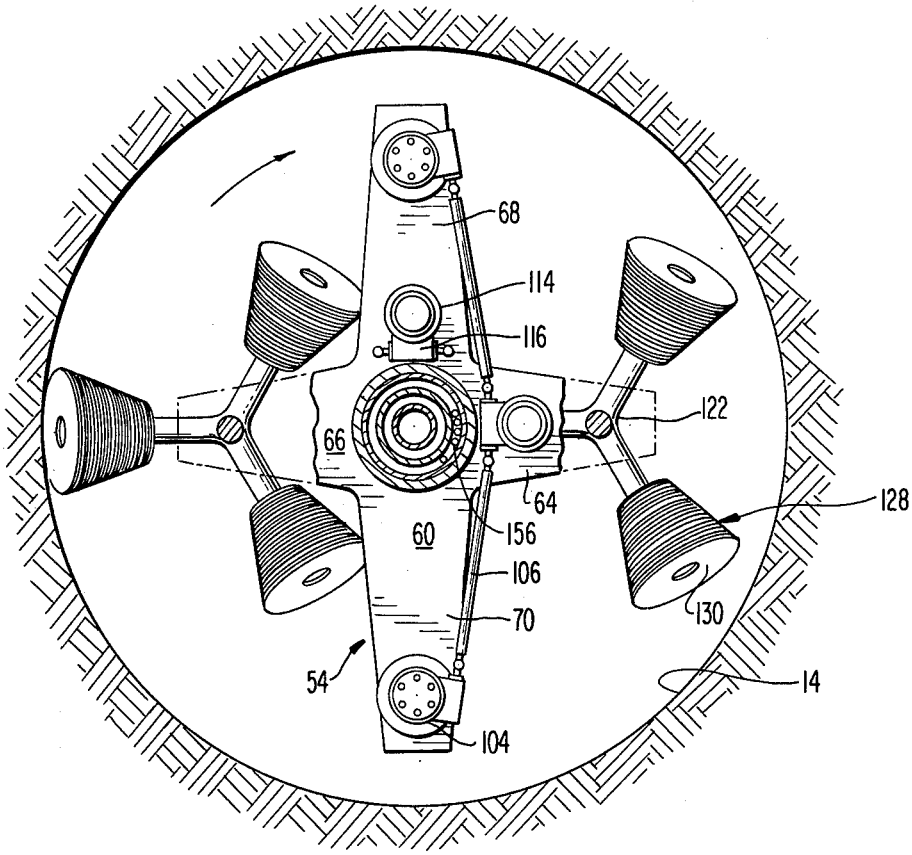
FIG. 3 is a view similar to FIG. 2, but taken below the drive wheels, and with portions of the base removed for disclosure of details.

The bottom end portion 48 of the casing is fixedly connected to a horizontal base member 54. The base member is of optional and variable design, but here is shown as of cruciform shape with a central hub 56 with an opening 58 receiving the casing, and having upper and lower sides 60 and 62. The cruciform configuration provides a pair of diametrically opposite cutter arms 64 and 66, and radially spaced, diametrically opposite pair of drive wheel arms 68 and 70 (FIGS. 2 and 3).

Fitted within the passageway 50 of the outer casing and inwardly spaced therefrom is a tubular exhaust tube 72. The exhaust tube 72 has a lower intake end 74 which projects, as shown in FIG. 6, below the base member 54, and an upper discharge end 76 with a flange 78 for connection to a suitable conduit. Below said base, the lower intake end 74 is integrally joined to a plurality of scavenging tubes 80. The scavenging tubes are hollow, and in fluid communication with the tube 72, and each has an outer vertically depending leg 82 with an enlarged mouth element 84 at its lower extremity.

A fluid input pipe is of reduced diameter relative to the exhaust tube 72, and has a top portion 88 and a bottom portion 90 with an end wall 92. Immediately above the end wall 92, ports 94 are formed in the portion 90 of the pipe 86, and spouts 96 are secured to the pipe about each of said ports. The spouts have downturned nozzles 98 at their ends.

Mounted on the upper side 60 of the base member 54 on said cutter arms 64 is a drive motor 100 with an output gear box 102 or other conventional drive conversion mechanism. On each of the drive wheel arms 68 and 70 of the base is a housing 104 for a worm gear drive (not shown), and shafts 106 from the gear box 102 drivingly engage the same. A driven stub axle 108 extends from each of the housings 104, and a drive wheel 110 with a friction tire 112 is secured thereto. The wheels are driven from the motor 100 to rotate the base by frictional contact of the friction tires. The motor may be of the reversible types so that the direction of the rotation of the unit can be changed.

A cutter motor 114 is mounted on the drive wheel arm 68 above the base, and has a operatively associated output gear 116. On the extremities of the cutter arms 64 and 66 are housings 118 with side worm gear portions 121. Shafts 120 are engaged at one end with the gear drive 116 and at the opposite end within the worm gear portions 121 in driving relation. Vertical drive cutter axles 122 extend from the housings 118 through the base. The plurality of downwardly and outwardly extending legs 124 are radially spaced on each axle, and the legs have upwardly inclined foot portions 126.

The cutting elements 128 hereof each comprises an assembly of disk form plates 130 suitably clamped together in freely rotatable fashion on the respective foot portions 126 of the axles 122. As seen in FIG. 1, the plates are of variable diameter, increasing from inside to out, such that, with the inclination of the foot portions, the peripheral cutting edges of the plates are disposed in contact with the shaft bottom 16.

Means 132 on the outer casing 44 and on the main body tube 22 for energizing the drive and cutter motors is provided. The particular means employed is a variable feature of the invention, and various optional power arrangements are contemplated according to energy availability, terrain and the like. In this illustration, the means 132 comprises a housing 134 secured on a base 136 above a collar 138 on the casing. As shown in FIG. 6, the collar is fixedly secured to the casing, as by a weld, but the base 136 is not, and the casing is free to rotate without the plate. An insulater sleeve 140 is attached to the casing within the housing, and a series of annular electrical contacts 142 are placed thereabout in spaced apart relation. A housing mount rod 144 is secured on the main body tube by gusset plates 146 and a slide bushing 148 in an opening 150 in the base 136 permits vertical sliding movement of the rod therein. The rod however prevents rotation of the base and housing with the casing. A power supply cable 152 extends to a power supply and control station (not shown) located on the surface. A series of stationary contacts 154 within the housing are in sliding engagement with annular contacts 142, and suitable electrical wiring 156 is positioned between the casing and the exhaust tube 72.

In FIGS. *7a* through *7d*, it is seen that start up involves initial erection of an above ground frame 158 comprising an outter super structure 160 and interior wall 162. The main body tube 22 is initially positioned within the wall confines and the jack assemblies 34 are extended to bring the abutment members 40 into contact with the walls. The exhaust tube 72 is connected to a pump 164 leading to a slurry discharge site, and the input pipe 86 has a pump 166 supplying fluid from a reservoir or other source. This places the cutting elements 128 on the surface as shown in FIG. *7a*. Rotation of the casing, base and cutting elements is then instituted by energization of the drive motor 100 resulting in the frictional contact of the tires 112 of the wheels 110. Fluid is introduced into the cutting area and forms a slurry with excavated material, the slurry being then expelled through the tube 72. In FIG. *7b* the drilling has progressed to a point near the vertical downward limit of the casing with respect to the main body tube, and shaft formation has occurred to a first depth. At this point, the jacks 34 are retracted and the main body tube lowered to the position shown in FIG. *7c*. The jacks are again extended at this point to bring the abutment member into contact partially with the wall 162 and partially with the shaft 14. FIG. *7d* shows completion of this cycle and it will be noted that the process of lowering the tube may continue until the desired drill depth is achieved.

It will of course be understood that during operation the cutter drive motors 114 are energized in order to drive the cutters.

I claim:

1. Earth drilling equipment for formation of large diameter shafts in earth, rock and the like, said equipment comprising:

a vertical main body tube having upper and lower ends and an outer side wall, the main body tube having a vertical bore therein;

a plurality of extensible and retractable jacks on the outer side wall, said jacks being movable into supporting relationship with the shaft to position the tube substantially centrally in the shaft and to fix said tube at vertically adjustable positions within said shaft, and being retractable inwardly to adjust the vertical position of the main body tube;

an elongated, tubular outer casing extending vertically through the bore of said main body tube, mounted for rotation therein, and having top and bottom end portions projecting outwardly of the upper and lower ends thereof;

a horizontal base member having a central hub section fixedly secured to the bottom end portion of the outer casing, said base member having upper and lower sides;

an exhaust tube fitted within the outer casing, said exhaust tube having a lower intake end projecting below the base member, and an upper discharge end;

a plurality of scavenging tubes connected to exhaust tube below the base and rotatable with the base;

a fluid input pipe mounted within the exhaust tube, and having top and bottom portions;

a plurality of spouts on said bottom portion of said input pipe;

at least one drive motor mounted on the upper side of the horizontal base;

at least one drive wheel rotatably mounted on the upper side of the base for direct peripheral contact with the shaft, and means drivingly connecting said drive motor to said wheel, the wheel being in frictional contact with the shaft whereby rotation of the wheel rotates said base and said outer casing;

at least one cutter motor on the upper side of the horizontal base;

cutter drive axles extending vertically, rotatably through the base and means connecting the axles with the cutter motor;

a plurality of cutting elements on each of the axles, said cutting elements each comprising a plurality of plates having peripheral cutting edges, being mounted for rotation about their axes and commonly about said axle such that the edges contact the earth or rock to be drilled to grind the same for mixture with the fluids from the input tube spouts to form a slurry for expulsion through said exhaust tube; and means on said casing and said main body tube for energizing said at least one drive and cutter motors, said jacks being mounted to said body tube outer side wall, just above said base member and in proximity to said cutting elements to cause said shaft to directly resist reaction torques on said body tube during rock drilling.

2. The invention of claim 1, wherein:

each of said axles has at least a pair of downwardly and outwardly extended legs thereon;

the legs each having an upwardly inclined foot;

the plurality of plates forming cutting elements being rotatably mounted on respective feet for rotation about the axis of the plates while said feet commonly rotate about the axis of the axle common thereto;

with the plates for each element being of varied diameter whereby the cutting edges of each, when mounted on the feet are substantially coplaner.

3. The invention of claim 1, wherein:

the base member has a pair of elongated arms, said at least one drive wheel comprises plural drive wheels, each arm carrying one of said drive wheels; and the base member having a pair of inboard arms each carrying one of said axles.

4. The invention of claim 1, wherein:

said means on said casing and said main body tube for energizing said motors comprises a housing;

a housing mount fixedly secured to said main body tube and securing said housing thereabove about the casing;

the casing having a plurality of annular electrical contacts in spaced relation thereon within the housing, and having electrical conduit means from the contacts to the respective motors;

a power source; and stationary contacts operatively connected to the power source and arranged within the housing for continuous sliding contact with the annular electrical contacts on the casing.

5. The invention of claim 1, wherein:

two drive wheels are provided on the upper side of the base for peripheral contact with the shaft on diametrically opposite sides of said base, and wherein said and least one drive motor is operatively coupled to both said drive wheels.

6. The invention of claim 1, further comprising:

an erected cylindrical start up shaft fixedly mounted above the terrain at the drill site;

the erected start up shaft being of a diameter co-equal with that of the drill shaft; and acting as an extension thereof such that said plurality of extensible and retractable jacks on the outer side wall initially contact the inner periphery of the erected start up shaft to fix said main body tube to permit said cutting element to contact the surface of the terrain and to initiate cutting of said shaft.

7. The invention of claim 6, wherein:

the cutting blade assemblies each comprise a series of three downwardly and outwardly inclined, radially spaced legs projecting from the axles;

an upwardly inclined foot on each of said legs; and said cutting elements comprising a plurality of plates rotatably mounted on each of the feet have peripheral cutting edges of gradually reduced diameter from the outer plate to the inner plate whereby the cutting edges are substantially co-planer and contact the material to be drilled, and wherein said plates rotate about the axis of the feet and said legs rotate about the axis of said axle upon operation of said at least one cutter motor to drive said axles for rotation about their axes.

* * * * *